US005267377A

United States Patent [19]

Gillis et al.

[11] Patent Number: 5,267,377

[45] Date of Patent: Dec. 7, 1993

[54] BUCKLE ASSEMBLY

[75] Inventors: Kevin M. Gillis, Sterling Hts.; Bob L. McFalls, Shelby Township, Macomb County, both of Mich.

[73] Assignee: TRW Vehicle Safety Systems Inc., Lyndhurst, Ohio

[21] Appl. No.: 938,957

[22] Filed: Sep. 1, 1992

[51] Int. Cl.[5] ..... A44B 11/00

[52] U.S. Cl. ..... 24/641; 24/633; 24/637

[58] Field of Search ..... 24/641, 642, 632, 633, 24/637, 573.5; 297/481

[56] References Cited

U.S. PATENT DOCUMENTS

| | | | |
|---|---|---|---|
| 3,534,448 | 10/1970 | Hughes | 24/637 |
| 3,605,207 | 9/1971 | Glauser et al. | 24/632 |
| 4,062,091 | 12/1977 | Holmberg . | |
| 4,527,317 | 7/1985 | Straszewski et al. | 24/641 |
| 4,577,378 | 3/1986 | Harenberg | 24/633 |
| 4,617,705 | 10/1986 | Anthony et al. . | |
| 4,642,857 | 2/1987 | Ono | 24/637 |
| 4,660,260 | 4/1987 | Ishiguro | 24/637 |
| 4,893,383 | 1/1990 | Quickel | 24/647 |
| 5,023,981 | 7/1991 | Anthony et al. . | |

*Primary Examiner*—Victor N. Sakran

*Attorney, Agent, or Firm*—Tarolli, Sundheim & Covell

[57] ABSTRACT

A buckle assembly (36) includes a latch member (50) which is movable between an engaged position and a release position. A pushbutton (88) is manually actuatable from a first position to a second position to move the latch member from the engaged position to the release position. The latch member is movable from the engaged position to the release position against force provided by only a latch spring (64) upon insertion of a tongue (38, 40) into the buckle assembly. The pushbutton is manually actuatable from the first position to the second position against a combined force provided by the latch spring and a coil spring (92). A one-piece plastic locator member (112) is mounted on a base (44) of the buckle assembly. The locator member extends into a belt receiving opening (46) in the base to protect the belt (32) against abrasion by the metal base. The locator member has a first recess (118) which receives an end portion of the coil spring and a second recess (122) which receives an end portion (82) of the latch spring. The coil spring extends from the recess in the locator member, through an opening (95) in the latch member, into engagement with the pushbutton.

11 Claims, 3 Drawing Sheets

BUCKLE ASSEMBLY

FIELD OF THE INVENTION

The present invention relates to a buckle assembly, and particularly to a buckle assembly which is used with a safety belt in a child restraint system for use in a vehicle.

BACKGROUND OF THE INVENTION

A child restraint system for use in a vehicle commonly includes a buckle that is attached to a crotch belt which extends between the legs of the child. The buckle interconnects the crotch belt with a pair of shoulder belts that extend across the shoulders of the child. The shoulder belts are connected with one or more tongues which latch into the buckle. When the child restraint system is in use, the child should not be able to actuate the buckle to disconnect the crotch belt from the shoulder belts. However, an adult should be able to insert the tongues connected with the shoulder belts quickly and easily into the buckle assembly when the belts are to be secured around the child.

SUMMARY OF THE INVENTION

In accordance with a preferred embodiment of the invention, a buckle assembly has a latch member which is movable against force provided by only a latch spring when a tongue is to be inserted into the buckle assembly. However, when the buckle assembly is to be released by manually actuating a pushbutton, the pushbutton is actuated against a combined force of the latch spring and a coil spring.

The buckle assembly includes a one-piece locator member. The locator member is mounted on a base of the buckle and prevents abrasion of a belt by engagement with the base. The locator member has a recess which receives a portion of the coil spring to position the coil spring relative to the pushbutton. In addition, the locator member has a recess which receives a portion of the latch spring to position the latch spring relative to the latch member. The coil spring extends through an opening in the latch member into engagement with the pushbutton.

BRIEF DESCRIPTION OF THE DRAWINGS

The above and other features of the present invention will become more apparent to those skilled in the art upon reading the following description of a preferred embodiment of the invention in view of the accompanying drawings, wherein.

DESCRIPTION OF PREFERRED EMBODIMENTS

The present invention relates to a buckle assembly for use in a safety belt system and for receiving first and second tongues. The present invention is applicable to various buckle assembly constructions.

Figure 1:
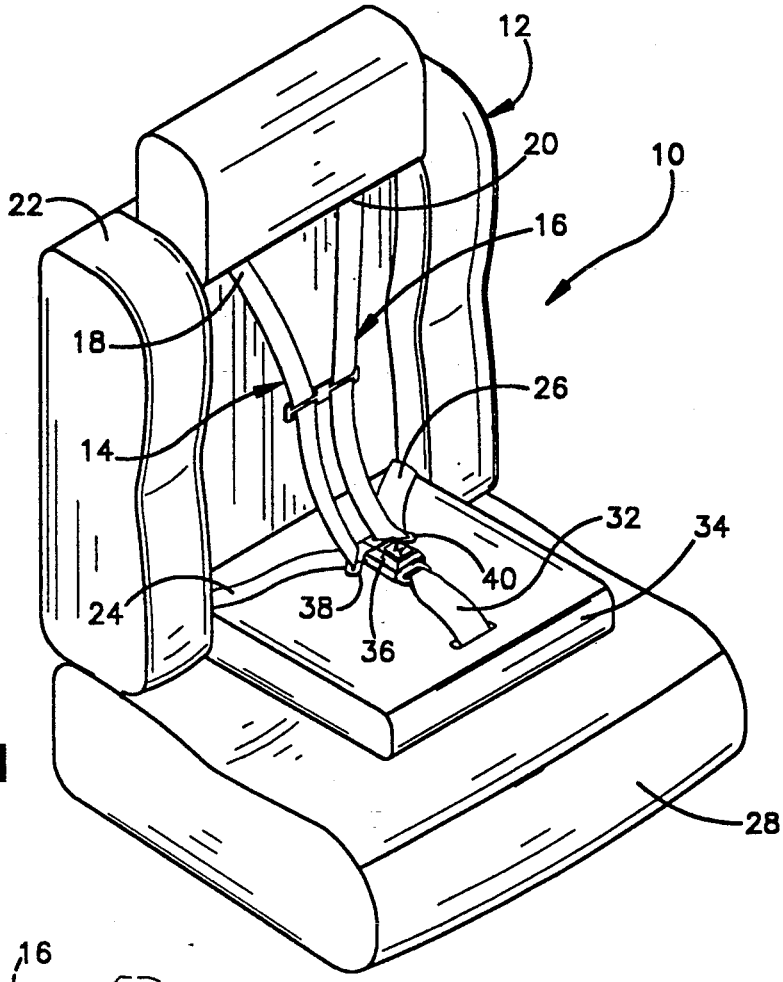
FIG. 1 is a pictorial illustration depicting the relationship of a child restraint system to a vehicle seat.

As representative of the present invention, FIG. 1 illustrates a child safety belt restraint system 10 in association with a vehicle seat 12. The child restraint system 10 includes a pair of shoulder belts 14 and 16. The shoulder belts 14 and 16 have upper end portions 18 and 20 which are secured to a back 22 of the vehicle seat 12. Lower end portions 24 and 26 of the shoulder belts 14 and 16 are secured to the vehicle seat 12 where the seat back 22 and a seat bottom cushion 28 come together.

Figure 2:
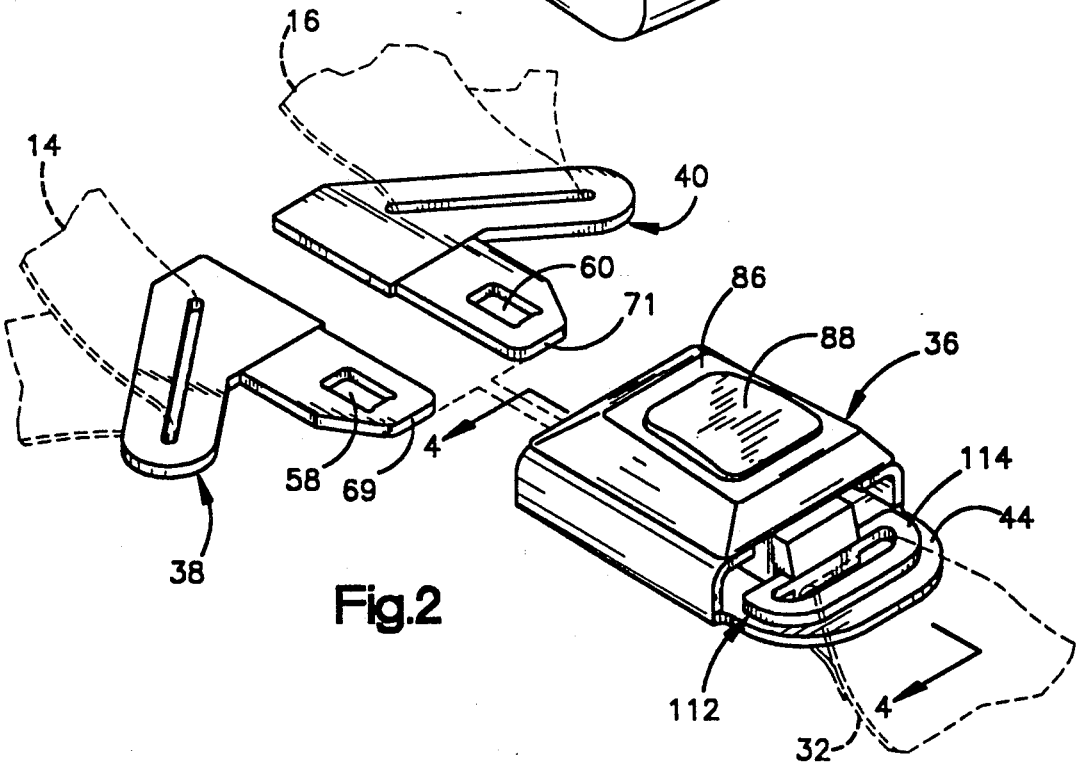
FIG. 2 is an illustration depicting the manner in which a pair of tongues are inserted into a buckle assembly to interconnect the tongues and buckle assembly.
Figure 3:
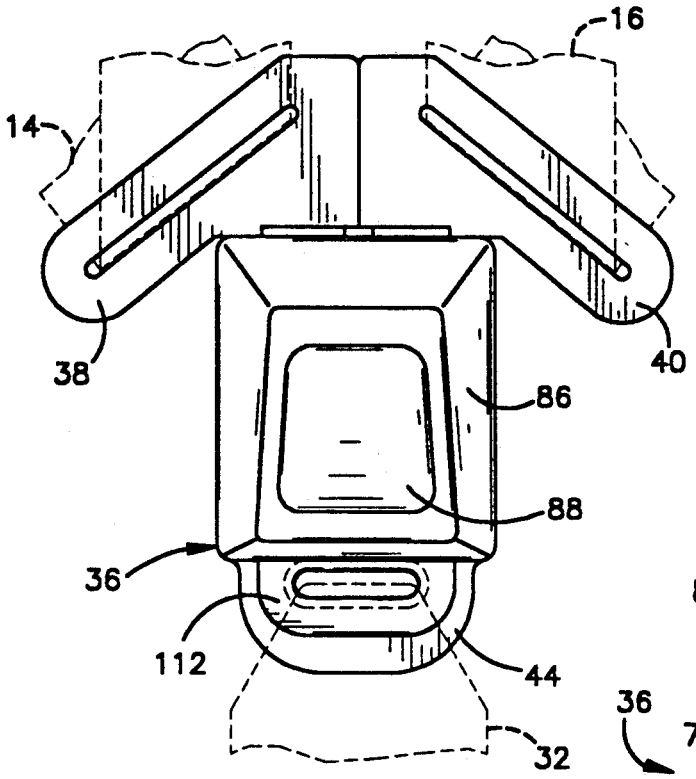
FIG. 3 is an illustration depicting the manner in which the tongues engage the buckle assembly.

The child restraint system 10 includes a crotch belt 32 which extends upwardly from a child seat cushion 34. A buckle assembly 36, constructed in accordance with the present invention, is attached to an upper end portion of the crotch belt 32. The buckle assembly 36 is engageable with a pair of tongues 38 and 40 (FIGS. 1-3) on the shoulder belts 14 and 16 to interconnect the shoulder belts and the crotch belt 32.

The buckle assembly 36 (FIGS. 4 and 5) includes a rectangular metal base 44 having a slot 46 for receiving the crotch belt 32. A metal latch member 50 is pivotally mounted at one end 74 on the base 44 for movement between an engaged position shown in FIG. 4 and a release position.

The latch member 50 is a generally planar metal piece having two latch lugs 54 and 56 which extend upwardly from the plane of the latch member. The latch lug 54 has a cam surface 70 facing an entrance opening 68 of the buckle assembly 36. The latch lug 56 has a cam surface 71 facing the entrance opening 68.

The latch member 50 has two actuator arms 98 and 100. The actuator arms 98 and 100 are located on opposite sides of the latch member 50 and partially define an opening 95 (FIG. 5) extending through the latch member. The latch member 50 also includes a divider tab 108. The divider tab 108 is a portion of the single piece of metal which forms the latch member 50. The divider tab 108 projects upwardly (as viewed in FIG. 4) in a direction from the base 44. The divider tab 108 is located at the center of the buckle assembly 36 as viewed from left to right in FIG. 3.

Figure 4:
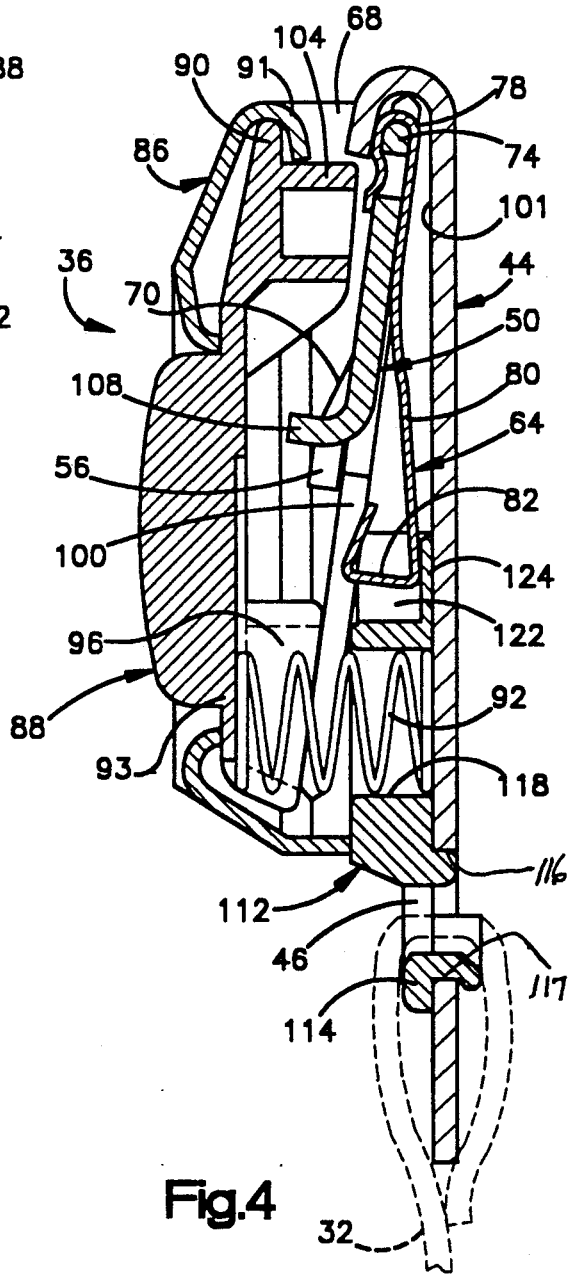
FIG. 4 is an enlarged sectional view, taken generally along the line 4—4 of FIG. 2.

The latch member 50 is urged to the engaged position, shown in FIG. 4, by only a latch spring 64. The latch spring 64 is a metal leaf spring and is disposed between the latch member 50 and the metal base 44. A mounting end portion 78 of the latch spring 64 is hooked around (FIGS. 4 and 5) the end portion 74 of the latch member 50 to connect the latch spring to the latch member. An arcuate main section 80 of the latch spring 64 engages a lower side surface of the latch member 50 and urges the latch member to pivot in a clockwise direction (as viewed in FIG. 4) around its end portion 74.

A generally rectangular metal cover 86 is secured to the base 44. A one-piece molded plastic pushbutton 88, for moving the latch member 50 between its engaged and disengaged positions, is mounted on the cover 86. The pushbutton 88 has an end portion 90 (FIG. 4) which pivotally engages an inturned lip 91 on the cover 86. The pushbutton 88 pivots about an axis which is generally parallel to the axis about which the latch member 50 pivots. Further, the pushbutton 88 extends roughly parallel to the latch member 50.

Figure 5:
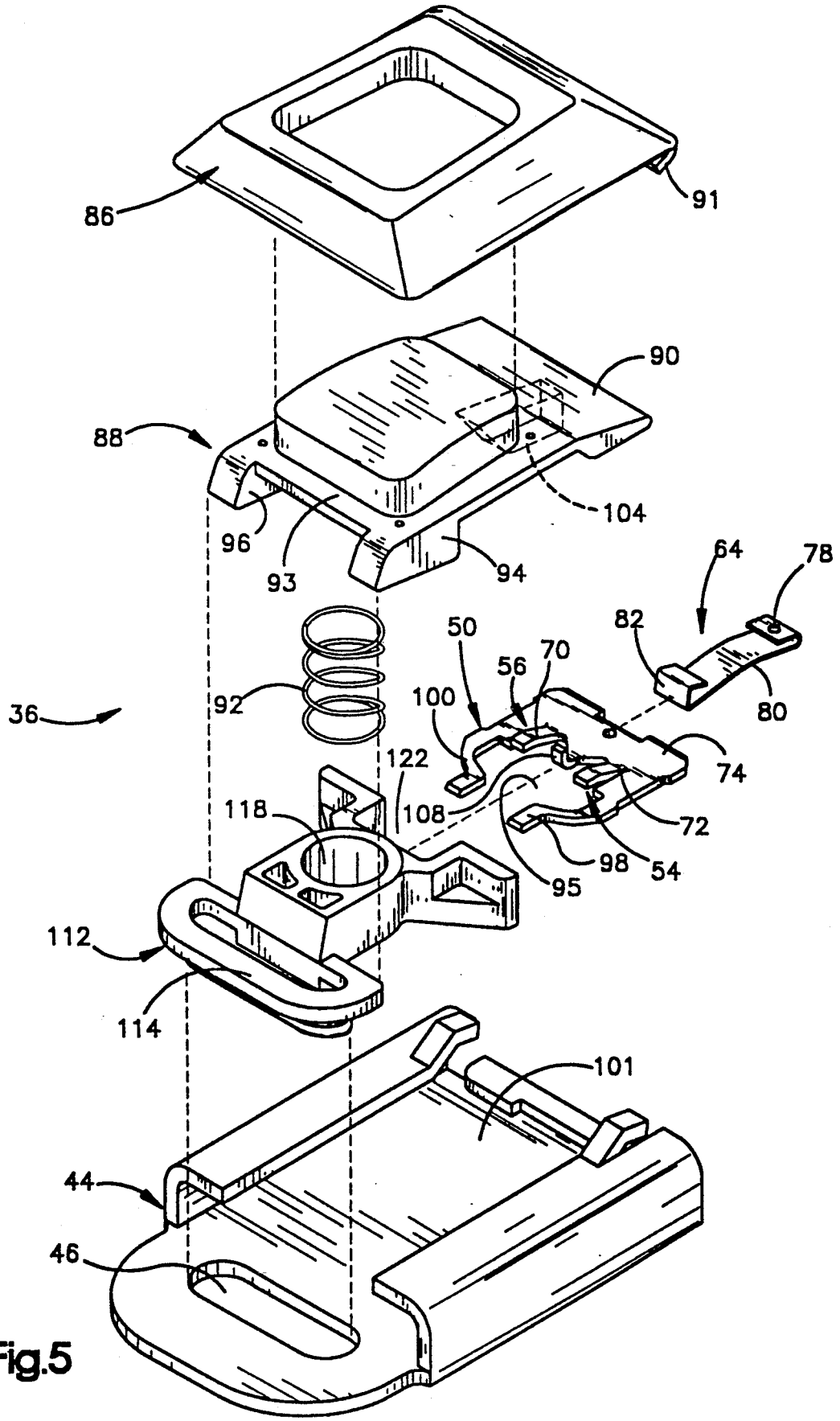
FIG. 5 is an exploded pictorial illustration of the components of the buckle assembly of FIG. 4.

The pushbutton 88 includes a divider section 104 (FIGS. 4 and 5). The divider section 104 is molded as part of the one piece plastic pushbutton 88. The divider section 104 is located at the entrance opening 68 of the buckle assembly 36. The divider section 104 is disposed between the insertion path of the tongue 38 and the insertion path of the tongue 40.

The pushbutton 88 has on its other end portion 93 two downwardly depending actuator lugs 94 and 96 (FIG. 5). The actuator lugs 94 and 96 are located on opposite sides of the pushbutton 88 and are spaced outside the opening 95 (FIG. 5) extending through the latch member 50.

A coil spring 92 urges the pushbutton 88 to the raised or unactuated position shown in FIG. 4. The coil spring 92 has a helical configuration. At one end, the coil spring 92 engages an end portion 93 of the pushbutton 88 opposite from the end portion 90 about which the pushbutton pivots. At its other end, the coil spring 92 engages the base 44. The coil spring 92 extends through the opening 95 in the latch member 50 between the actuator arms 98 and 100.

A one-piece molded plastic locator member 112 is mounted on the metal base 44 (FIGS. 4 and 5). A belt guard portion 114 of the locator member 112 extends along a major side surface 101 of the base 44 (FIG. 4) to the slot 46. The belt guard portion 114 extends into the slot 46 across a surface 116 of the base 44 which defines one side of the slot 46. The belt guard portion 114 wraps around the surface 117 which defines the other side of the slot 46 and extends along both major side surfaces of the base 44 adjacent the surface 117. The belt guard portion thus prevents the crotch belt 32 (FIG. 1) from rubbing against the metal base 44 (FIG. 4), which might result in abrasion of the crotch belt.

The locator member 112 has a cylindrical recess 118 in which an end portion of the coil spring 92 is received. The locator member 112 engages the turns of the coil spring 92 to hold the coil spring in position relative to the base 44 during movement of the pushbutton 88. In the illustrated embodiment of the invention, the recess 118 is open at its lower end so that the coil spring abuts the base 44. If desired, however, the recess 118 could be formed with an end wall which would be engaged by the coil spring 92.

A rectangular recess 122 (FIGS. 4 and 5) is also formed in the locator member 112. A head end portion 82 of the latch spring 64 extends into the recess 122 to position the latch spring relative to the base 44. The recess 122 has a relatively thin bottom wall 124 (FIG. 4) which is slidably engaged by the head end portion 82 of the latch spring 64. The head end portion 82 of the latch spring 64 is pressed against the bottom wall 124 by the main portion 80 of the latch spring. Since the locator member 112 is molded of a single piece of plastic, the bottom wall 124 is formed of plastic and has a relatively low coefficient of friction. Therefore, the head end portion 82 of the latch spring 64 can readily move relative to the locator member 112 during deflection of the latch plate 50 and flexing of the latch spring 64.

When a child is to be secured in the restraint system 10, the shoulder belts 14 and 16 are positioned around the shoulders of the child. The crotch belt 32 extends upwardly between the child's legs. The tongues 38 and 40 are inserted into the buckle assembly 36 to interconnect the shoulder belts 14 and 16 and the crotch belt 32.

When the tongues 38 and 40 are inserted into the buckle assembly 36 through the entrance opening 68, a leading edge 69 (FIG. 2) of the tongue 38 engages the cam surface 70 (FIG. 5) on the latch lug 56. A leading edge 71 of the tongue 40 engages the cam surface 72 on the latch lug 54. As the tongues 38 and 40 continue to be inserted into the buckle assembly 36, the latch member 50 is pivoted in a counterclockwise direction (as viewed in FIG. 4) about its end portion 74.

Pivotal movement of the latch member 50 is resisted by only the latch spring 64. The pivotal movement of the latch member 50 continues until the latch lugs 54 and 56 snap into the openings 58 and 60 in the tongues 38 and 40. The latch lugs 54 and 56 then hold the tongues 38 and 40 in the buckle assembly 36. The shoulder belts 14 and 16 are thus interconnected with the crotch belt 32, and the child is secured in the restraint system 10.

During insertion of the tongues 38 and 40 into the buckle assembly 36, the divider section 104 on the pushbutton 88 guides the tongues into their respective insertion paths. As each tongue 38 or 40 is inserted into the buckle assembly 36, the divider section 104 constrains the tongue for insertion only into its respective insertion path, and blocks movement of the tongue into the other insertion path. The divider section 104 also helps align the tongues 38 and 40 with their respective latch lugs 54 and 56.

The divider tab 108 on the latch member 50 helps maintain the tongues 38 and 40 in alignment with the latch lugs 54 and 56, respectively. The divider tab 108 projects upwardly at the center of the buckle assembly 36, between the tongue 38 and the tongue 40, when the tongues are in the buckle assembly 36. The divider tab 108 engages an inner side surface 160 (FIG. 2) of the tongue 38 and an inner side surface 162 of the tongue 40 to maintain the tongues in alignment with the latch lugs 54 and 56. The divider tab 108 resists cam-out of the tongues 38 and 40, i.e., rotational movement of the tongues within the buckle assembly 36 about an axis extending normal to the plane of the base 44.

To release the tongues 38 and 40 from the buckle assembly 36, the pushbutton 88 is manually actuated. The pushbutton 88 pivots in a counterclockwise direction (as viewed in FIG. 4) against the force of the coil spring 92. The lugs 94 and 96 (FIG. 5) on the pushbutton 88 engage the actuator arms 98 and 100 on the latch member 50 to pivot the latch member 50 in a counterclockwise direction against the force of the latch spring 64. The latch lugs 54 and 56 are moved out of the tongue openings 58 and 60, respectively. The tongues 38 and 40 can then be removed from the buckle assembly 36.

The force which is applied against the pushbutton 88 to actuate the pushbutton and pivot the latch member 50 must be sufficient to overcome the force of both the coil spring 92 and the latch spring 64. The coil spring 92 is relatively strong. Therefore, a child cannot actuate the pushbutton 88 against the influence of both the coil spring 92 and the latch spring 64. This prevents a child from releasing the restraint system 10.

To insert the tongues 38 and 40 into the buckle assembly 36, it is necessary to move the latch member 50 against the influence of only the latch spring 64. Therefore, a relatively small force is required to press the tongues 38 and 40 into the buckle assembly 36. This makes it relatively easy for an adult to secure the restraint system 10 around a child.

Although the buckle assemblies 36 and 36A have been disclosed herein in association with a child restraint system 10, either buckle assembly could be used in other restraint systems having a safety belt. For example, the child restraint system 10 has been illustrated in FIG. 1 as being permanently installed in association with the vehicle seat 12, with the child seat cushion 34 being folded down out of the seat back 22. Nonetheless, the child restraint system 10 could be used in association with a child seat which is separate from the vehicle seat 12 and is portable.

From the above description of the invention, those skilled in the art will perceive improvements, changes and modifications in the invention. Such improvements, changes and modifications within the skill of the art are intended to be covered by the appended claims.

We claim:

1. A buckle assembly for receiving a tongue, said buckle assembly comprising:

a latch member in which an opening is formed and which is movable between an engaged position and a release position;

a pushbutton which is manually actuatable from a first position to a second position to move said latch member from the engaged position to the release position;

a latch spring which provides force urging said latch member to the engaged position, said latch member being movable from the engaged position to the release position against force provided by said latch spring upon insertion of a tongue into said buckle assembly;

a coil spring which extends through the opening in said latch member and which thus bypasses said latch member, said coil spring further extending into engagement with said pushbutton and providing force urging said pushbutton to the first position, said pushbutton being manually actuatable from the first position to the second position against a combined force provided by said latch spring and said coil spring to move said latch member from the engaged position to the release position; and means for supporting said pushbutton for pivotal movement about a first end portion of said pushbutton during movement of said pushbutton between the first and second positions, said coil spring being effective to provide force which is applied to a second end portion of said pushbutton opposite from said first end portion of said pushbutton.

2. A buckle assembly as set forth in claim 1 further including means for supporting said latch member for pivotal movement about a first end portion of said latch member, said second end portion of said pushbutton being effective to apply force against a second end portion of said latch member opposite from said first end portion of said latch member upon manual actuation of said pushbutton.

3. A buckle assembly as set forth in claim 2 wherein said opening in said latch member is in the second end portion of said latch member, and said coil spring extends into engagement with said second end portion of said pushbutton.

4. A buckle assembly as set forth in claim 3 wherein said latch spring is a leaf spring which is connected with the first end portion of said latch member and applies force against a first side of said latch member, said pushbutton being engageable with a second side of said latch member to apply force against the second side of said latch member.

5. A buckle assembly for receiving a tongue, said buckle assembly comprising:

a base having an opening for receiving a belt;

a latch member connected with said base and movable relative to said base between an engaged position and a release position;

a pushbutton which is connected with said base and is manually actuatable from a first position to a second position to move said latch member from the engaged position to the release position;

a spring for providing a force against which said pushbutton is actuated during movement of said latch member from the engaged position to the release position; and a one-piece locator member mounted on said base and having a portion extending into the opening in said base to block engagement of a belt with said base at the location where the belt extends through the opening in the base, said locator member having a recess which receives at least a portion of said spring to position said spring relative to said base.

6. A buckle assembly as set forth in claim 5 wherein said spring is a coil spring having an end portion disposed in the recess in said locator member and a central axis extending perpendicular to a major side surface of said base.

7. A buckle assembly as set forth in claim 5 wherein said spring is a leaf spring having a main portion disposed between said base and latch member and an end portion disposed in the recess in said locator member.

8. A buckle assembly for receiving a tongue, said buckle assembly comprising:

a latch member in which an opening is formed and which is movable between an engaged position and a release position;

a pushbutton which is manually actuatable from a first position to a second position to move said latch member from the engaged position to the release position;

a latch spring which provides force urging said latch member to the engaged position, said latch member being movable from the engaged position to the release position against force provided by said latch spring upon insertion of a tongue into said buckle assembly;

a coil spring which extends through the opening in said latch member and which thus bypasses said latch member, said coil spring further extending into engagement with said pushbutton and providing force urging said pushbutton to the first position, said pushbutton being manually actuatable from the first position to the second position against a combined force provided by said latch spring and said coil spring to move said latch member from the engaged position to the release position;

a metal base having an opening for receiving a belt; and a one-piece locator member formed of plastic and mounted on said base, said locator member extending through the opening in said base to block engagement of said base with a belt received in the opening, said locator member having a first recess for receiving an end portion of said coil spring to position said coil spring relative to said base and a second recess for receiving an end portion of said latch spring.

9. A buckle assembly for receiving a tongue, said buckle assembly comprising:

a base having an opening for receiving a belt;

a latch member connected with said base and movable relative to said base between an engaged position and a release position;

a pushbutton which is connected with said base and is manually actuatable from a first position to a second position to move said latch member from the engaged position to the release position;

a spring for providing a force against which said pushbutton is actuated during movement of said latch member from the engaged position to the release position;

a one-piece locator member mounted on said base and having a portion extending into the opening in said base to block engagement of a belt with said base at the location where the belt extends through the opening in the base, said locator member having a recess which receives at least a portion of said spring to position said spring relative to said base; and a second spring for providing a force against which said pushbutton is actuated during movement to said latch member from the engaged position to the release position, said locator member having a second recess which receives at least a portion of said second spring to position said second spring relative to said base.

10. A buckle assembly for receiving a tongue, said buckle assembly comprising:

a base having an opening for receiving a belt;

a latch member connected with said base and movable relative to said base between an engaged position and a release position;

a pushbutton which is connected with said base and is manually actuatable from a first position to a second position to move said latch member from the engaged position to the release position;

a spring for providing a force against which said pushbutton is actuated during movement of said latch member from the engaged position to the release position;

a one-piece locator member mounted on said base and having a portion extending into the opening in said base to block engagement of a belt with said base at the location where the belt extends through the opening in the base, said locator member having a recess which receives at least a portion of said spring to position said spring relative to said base; and said latch member having an opening formed therein, said spring being a coil spring which extends through the opening in said latch member and which thus bypasses said latch member, said coil spring further extending into engagement with said pushbutton, said locator member having a first recess which receives an end portion of said coil spring, said buckle assembly further including a second spring which provides a force urging said latch member to the engaged position, said locator member having a second recess which receives a portion of said second spring.

11. A buckle assembly for receiving a tongue, said buckle assembly comprising:

a latch member in which an opening is formed and which is movable between an engaged position and a release position;

a pushbutton which is manually actuatable from a first position to a second position to move said latch member from the engaged position to the release position;

a latch spring which provides force urging said latch member to the engaged position, said latch member being movable from the engaged position to the release position against force provided by said latch spring upon insertion of a tongue into said buckle assembly; and a spring having a first end and a second end, said spring extending through the opening in said latch member and thus bypassing said latch member between said ends of said spring, said spring further extending into engagement with said pushbutton at one of said ends of said spring to provide force urging said pushbutton to the first position, said pushbutton being manually actuatable from the first position to the second position against a combined force provided by said latch spring and said spring to move said latch member from the engaged position to the release position.

* * * * *

UNITED STATES PATENT AND TRADEMARK OFFICE

CERTIFICATE OF CORRECTION

PATENT NO. : 5,267,377

DATED : December 7, 1993

INVENTOR(S) : Kevin M. Gillis and Bob L. McFalls

It is certified that error appears in the above-indentified patent and that said Letters Patent is hereby corrected as shown below:

Column 7, line 21, change "to" to --of--.

Signed and Sealed this

Twentieth Day of September, 1994

Bruce Lehman

*Attest:*

BRUCE LEHMAN

*Attesting Officer*

*Commissioner of Patents and Trademarks*